United States Patent [19]

Bosman

[11] 3,962,978

[45] June 15, 1976

[54] HANDLING OF HOT PARTICULATE MATERIALS, SUCH AS FOR EXAMPLE, HOT AGGLOMERATED COAL ASH AND COAL ASH CLINKER

[75] Inventor: Abraham Daniel Bosman, Sasolburg, South Africa

[73] Assignee: South African Coal, Oil and Gas Corporation Limited, Sasolburg, South Africa

[22] Filed: Feb. 27, 1975

[21] Appl. No.: 553,787

[30] Foreign Application Priority Data

Feb. 27, 1974 South Africa ..... 74/1296

[52] U.S. Cl. ..... 110/165 R; 110/171

[51] Int. Cl.[2] ..... F23J 1/00

[58] Field of Search ..... 110/165 R, 165 A, 171

[56] References Cited

UNITED STATES PATENTS

| | | | |
|---|---|---|---|
| 1,707,343 | 4/1929 | Allen | 110/165 |
| 1,729,603 | 10/1929 | Allen | 110/171 |
| 2,579,402 | 12/1951 | Silk | 110/171 |
| 3,824,935 | 7/1974 | Yamato et al. | 110/171 |

*Primary Examiner*—Kenneth W. Sprague

*Attorney, Agent, or Firm*—Young & Thompson

[57] ABSTRACT

A method of handling hot particulate material including the steps of producing a flow of liquid coolant in which there is substantially no increase in the width of flow with increasing depth; introducing hot particulate material into the path of flow of coolant to create a temporary barrier arresting the flow of coolant; and allowing accumulated coolant to breach the barrier and carry away with it particulate material of the temporary barrier.

21 Claims, 4 Drawing Figures

HANDLING OF HOT PARTICULATE MATERIALS, SUCH AS FOR EXAMPLE, HOT AGGLOMERATED COAL ASH AND COAL ASH CLINKER

This invention relates to the handling of hot particulate material, such as for example, hot agglomerated coal ash and coal ash clinker.

These are several methods of handling hot agglomerated coal ash and hot coal ash clinker. For example, mechanical systems incorporating mechanical conveyors and hydraulic systems incorporating pipe lines are known. As far as Applicants are aware, most if not all the known systems suffer from one or other disadvantage. Thus, hydraulic systems normally suffer from the disadvantage of high abrasive wear of pipe lines and pumps.

It is an object of the present invention to provide an improved hydraulic system for handling hot particulate material.

According to the invention a method of handling hot particulate material includes the steps of producing a flow of liquid coolant in which there is substantially no increase in the width of flow with increasing depth; introducing hot particulate material into the path of flow of coolant to create a temporary barrier arresting the flow of coolant; and allowing accumulated coolant to breach the barrier and carry away with it particulate material of the temporary barrier.

The particulate material may be introduced into the path of flow of the coolant in such a manner that after breach of the temporary barrier further particulate material continues to move into the path of flow of the coolant, the flow of coolant after breach of the temporary barrier being such that it continues to carry away with it further particulate material entering the path of flow.

The liquid coolant may comprise water.

Preferably, the rate of flow of liquid coolant is relatively low.

The rate of flow of coolant is preferably such that wear of the surface over which flow occurs, is inhibited or minimised. The rate of flow may be such that a protective layer of particulate material is formed on the surface.

Hot particulate material may be introduced intermittently into the path of flow of liquid coolant in batch-wise fasion.

In a preferred embodiment, hot particulate material is received in a recieving zone offset transversely from the longitudinal centre line of the path of flow of coolant and particulate material is caused or allowed to enter the path of flow from the receiving zone.

Particulate material may enter the flow path from the receiving zone under the influence of gravity.

Particulate material preferably enters the path of flow at an angle to the longitudinal centre line of the flow path in the general direction of coolant flow.

Further according to the invention the liquid coolant may flow along an enclosed passage and sub-atmospheric pressure conditions may be set up above the flow of coolant to avoid or at least to minimize pressure build-up by the generation of steam or other vapour when hot particulate material comes into contact with the liquid coolant along the path of flow.

Steam or other vapour may be extracted from the enclosed passage. Extracted vapour may be condensed.

Dust may be removed from the vapour.

With the method according to the invention, hot particulate material may be transported by the liquid coolant to any required location. During transportation, the hot particulate material may be cooled by the liquid coolant to a temperature suitable for further transportation and/or disposal. The liquid coolant also acts to avoid or at least to minimise dust formation during transportation of the particulate material. By receiving the hot particulate material in a receiving zone which is offset transversely from the longitudinal centre line of the path of flow of coolant, blockages permanently arresting the flow of coolant may be avoided or at least minimised, particularly in a case where the particulate material is received batch-wise.

According to another aspect of the invention means for handling hot particulate material includes a longitudinally inclined sluiceway with a cross-sectional configuration such that there is substantially no increase in the width of a flow of liquid therealong with increasing depth; a receiving zone transversely offset from the longitudinal centre line of the sluiceway, the receiving zone being adapted to receive hot particulate material and to cause or allow such material to enter the sluiceway; and means adapted to introduce liquid coolant into the sluiceway to produce a flow of coolant over substantially the entire width of the sluiceway past the region in which particulate material enters the sluiceway from the receiving zone.

The sluiceway may have a substantially plane bottom and sides, the sides being substantially vertical or inclined to converge upwardly.

Preferably, the receiving zone is adapted to cause or allow particulate material to enter the sluiceway in such a manner in relation to the flow of the coolant along the sluiceway that a temporary barrier of particulate material which can be breached and washed away by accumulated coolant is formed initially in the sluiceway, and after breach of the temporary barrier further particulate material continues to enter the sluiceway at such a rate that the flow of coolant can continue to carry such further particulate material away with it.

The receiving zone may comprise a ramp sloping downwardly towards the sluiceway at an angle to the longitudinal centre line of the sluiceway and in the general direction in which the sluiceway slopes.

The liquid coolant may be introduced turbulently into the sluiceway to disperse the flow of coolant over substantially the entire width of the sluiceway.

The means for introducing liquid coolant into the sluiceway may comprise a conduit with an orifice adapted to admit the coolant into the sluiceway at a predetermined rate, preferably a relatively low rate.

The rate of introduction of liquid coolant into the sluiceway, the inclination of the sluiceway and the width of the sluiceway are preferably related such that particulate material is washed down the sluiceway by the coolant at a rate at which wear of the sluiceway is inhibited or minimised. The rate of flow of coolant down the sluiceway may be such that a protective layer of particulate material is formed on the bottom of the sluiceway and excess particulate material is washed down the sluiceway over the protective layer. Normally, a permanent protective layer will not be formed but particulate material forming the protective layer will be replaced continuously by fresh particulate material.

Further according to the invention, the sluiceway may be enclosed and means provided to produce sub-atmospheric pressure conditions in the sluiceway. This minimises or avoids the escape of dust and of hot vapour which is formed when hot particulate material comes into contact with liquid coolant in the sluiceway. It also avoids or minimises pressure build-up in the enclosed sluiceway when vapour is formed.

Thus, an extraction fan may be provided to suck air and/or vapour from the enclosed sluiceway.

The cross-sectional area of the sluiceway may increase in the direction in which the sluiceway slopes so that it presents an expansion system of considerable surge capacity to accommodate surges of vapour which are generated when successive batches of hot particulate material are introduced into the sluiceway.

Preferably, air and/or vapour is extracted from the sluiceway in the same direction in which the cross-sectional area of the sluiceway increases, thereby to create a flow of vapour down the sluiceway in the direction of expansion.

Means may be provided for condensing vapour extracted from the sluiceway. The condensing means may comprise one or more water sprays in a suction duct leading from the sluiceway to the extraction fan. The consing means may also be adapted to remove dust from the extracted vapour.

The arrangement may be such that a regulated amount of air is sucked into the sluiceway. Air sucked into the sluiceway may serve as extra cooling medium in the system.

A plurality of spaced receiving zones may be provided along the sluiceway.

A plurality of branch sluiceways, each with a plurality of receiving zones spaced therealong, may join a main sluiceway leading to a required location, such as de-watering plant in a case where water is used as coolant. The main sluiceway may or may not be provided with its own receiving zones.

Any suitable sealing means may be provided towards the end of a sluiceway. Where a plurality of branch sluiceways join a main sluiceway, sealing means may be provided towards the end of the main sluiceway.

The sluiceway or sluiceways may be provided with a heat and wear resistant lining.

For a clear understanding of the invention, a preferred embodiment will now be described by way of example with reference to the accompanying drawings in which.

Figure 1:
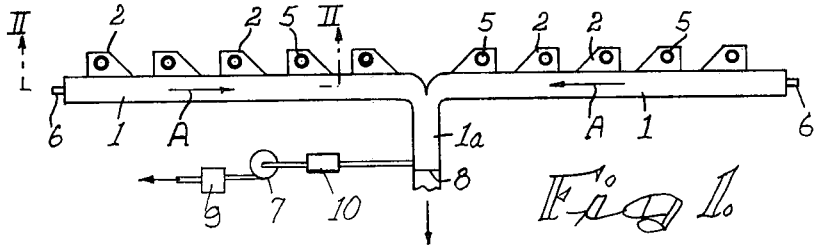
FIG. 1 is a diagrammatic plan view of means according to the invention for handling hot coal ash received batch-wise from a plurality of gasifier ash hoppers.
Figure 2:
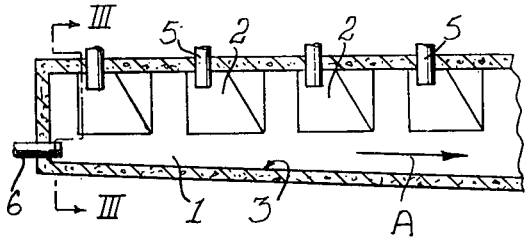
FIG. 2 is a diagrammatic sectional elevation to an enlarged scale on the line II—II in FIG. 1.

The system comprises two branch sluiceways 1 which join a main sluiceway 1*a* (FIG. 1) leading to an ash de-watering plant (not shown). Branch sluiceways 1 and main sluiceway 1*a* are of rectangular cross-sectional configuration with substantially plane bottoms 3 and substantially plane vertical sides 7 as can best be seen from FIG. 3. As can be seen from FIG. 2, each branch sluiceway 1 slopes downwardly in the direction of arrow A from its outer end towards the main sluiceway 1*a* which, in turn slopes downwardly from its junction with branch sluiceways 1 towards the ash de-watering plant.

Figure 3:
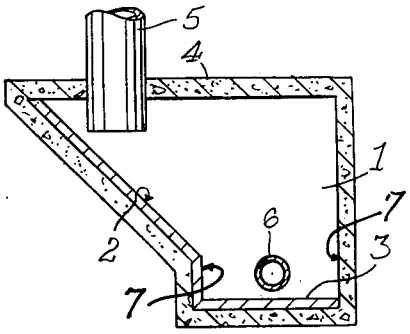
FIG. 3 is a diagrammatic sectional view to an enlarged scale of a branch sluiceway and an ash receiving ramp of the system on the line III—III in FIG. 2.
Figure 4:
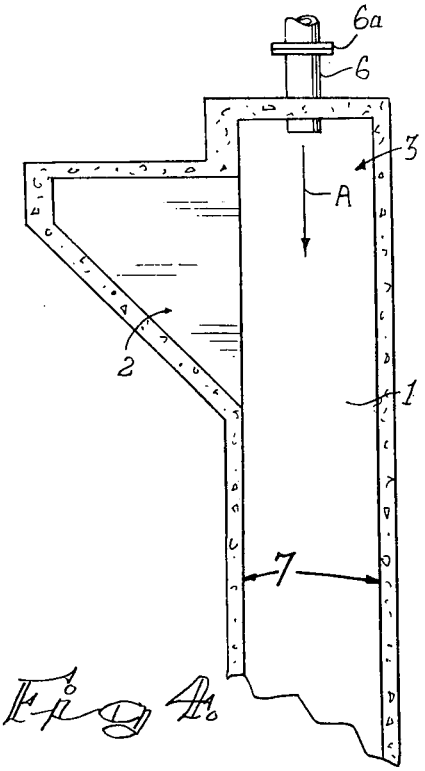
FIG. 4 is a diagrammatic plan view of the sluiceway and ash receiving ramp of FIG. 3 with the roof and dumping pipe removed.

Sluiceways 1, 1*a* are covered by horizontal roof slabs 4 so that they define enclosed passages whose cross-sectional areas increase in the directions in which they slope. An expansion system of considerable surge capacity is thus formed. A plurality of ash receiving ramps 2 are located in spaced relationship to each other along each of the branch sluiceways 1. As can best be seen from FIGS. 1 and 3, each ramp 2 is offset transversely from the centre line of its branch sluiceway 1. As shown in FIGS. 3 and 4, each ramp 2 slopes downwardly at an angle to the longitudinal centre line of its sluiceway 1 and in the general direction of arrow A in which the sluiceway slopes. Above each ramp 2 and passing through the roof thereof, is an ash dumping tube 5 from a gasifier ash hopper (not shown).

The bottoms of sluiceways 1 and 1*a* as well as the sides of sluiceways 1 opposite ash receiving ramps 2 and also the bottoms and sides of ramps 2 are lined with heat and water resistant material.

At the upper end of each branch sluiceway 1 is a water inlet tube 6 including a restriction orifice 6*a* (FIG. 4) adapted to admit cooling water at a predetermined low rate into its branch sluiceway. Water introduced into the branch sluiceways 1 flows down the branch sluiceways in the directions indicated by arrows A, past the ash receiving ramps 2, and along the main sluiceway 1*a*. The water is introduced turbulently into branch sluiceways 1 through inlet tubes 6 so that the water flows over substantially the entire widths of the sluiceways past ramps 2.

In use, hot ash, which may be at a temperature of 300° to 350° C and even as high as 450° for short periods, is dumped at intervals in batches through dumping tubes 5 onto ash receiving ramps 2 from where the hot ash slides into the associated branch sluiceway. The surface area and inclination of each ramp 2 is such in relation to the volumes of successive batches of ash dumped onto it and to the flow of water along its branch sluiceway, that ash from a dumped batch slides down the ramp into the branch sluiceway intitially to form a temporary barrier across the sluiceway to arrest the flow of water therealong. The temporary barrier is such that water accumulating behind it, can breach the barrier and wash the ash forming the barrier away with it along the sluiceway. After breach of the temporary barrier further ash from the same batch slides into the branch sluiceway from the ramp 2 at such a rate that the flow of water can continue to carry such further ash away with it.

Due to the fact that the ash receiving ramps 2 are offset from the longitudinal centre lines of the branch sluiceways 1 so that batches of ash are not dumped directly in to the sluiceways but slide from the inclined ramps 2 into the sluiceways 1 at a rate dependent on the inclination of the ramps 2 and on the size of each batch of ash, which may be as large as 6 $m^3$ or more, branch sluiceways 1 are not blocked up permanently when a dump occurs.

Due to the fact that sluiceways 1 have plane vertical sides, the flow of water along sluiceways 1 is such that there is no increase in the width of flow with increasing depth. As a result, the force of accumulated water behind a temporary barrier is not dispersed by an increase in the width of flow.

The inclinations and widths of the branch sluiceways 1 and the rate at which cooling water is introduced into the branch sluiceways 1 through inlet tubes 6, are related so that ash sliding into the branch sluiceways 1 from the ash receiving ramps 2 is washed down the branch sluiceways 1 and along main sluiceway 1*a* at a speed such that as little as possible wear of the linings of the sluiceways occurs. Preferably, a protective layer of ash is formed on the bottom of the sluiceways.

As an example of a suitable relationship, branch sluiceways 1 may each have an inclination of 1 in 24 and a width of 1 m and may each be provided with five ash receiving ramps 2 which are inclined at 45° to the horizontal and which are spaced at 7 meter centers from one another. Water may be introduced into each branch sluiceway 1 through its inlet tube 6 at a substantially constant rate of about 150 litres per second while 6 ton batches of ash are dumped onto successive ramps 2 of each branch sluiceway 1 at a rate of 4 to 6 tons per minute every ½ hour. The arrangement is such that an ash-water mixture flows down the sluiceways at a steady speed fast enough to keep ash particles of up to 100 mm size moving, but not too fast so that excessive wear of the sluiceway linings occur.

It will be appreciated that when hot ash contacts the cooling water in the sluiceways, high temperature steam is formed. In order to prevent dangerous pressure build-ups in the enclosed sluiceways and also to minimize any escape of high temperature steam from the sluiceways, air and steam are sucked from the sluiceways by means of extraction fan 7 (FIG. 1) communicating with main sluiceway 1*a*, thereby to create sub-atmospheric pressure conditions in the sluiceways. The sub-atmospheric pressure may, for example, be 125 milliliters water gauge. The air and vapour is extracted in the same direction in which the cross-sectional areas of the sluiceways increase, thereby to create a flow of vapour down the sluiceways in the direction of expansion.

A sealing flap 8 is provided across main sluiceway 1*a* in a position where its roof ends. Sealing flap 8 allows the ash-water mixture flowing down main sluiceway 1*a* to flow out of the system to the dewatering plant, but limits the amount of air that is sucked in. A regulated amount of air is sucked into the sluiceways and this air serves as additional cooling medium in the system.

Short-time high pressure build-ups or surges of steam which may occur when several gasifiers are de-ashed substantially simultaneously, are accommodated by the surge capacity of the large vapour space volume in the sluiceway system and by the slight vacuum which is normally maintained in the sluiceways in extraction fan 7.

Since the sluiceways are completely enclosed, dust laden air and steam are contained in the sluiceway system.

In order to condense steam extracted from the sluiceways and also to remove ash dust in the steam, one or more water sprays 10 may be provided in the suction duct between main sluiceway 1*a* and extraction fan 7. Scrubbing means 9 may be provided on the outlet side of fan 7. As a result, only clean air and water vapour is emitted to atmosphere.

Inspection man-holes (not shown) may be provided at intervals along the sluiceways, the covers of the man-holes also acting as pressure release valves in the event of excessive pressure building up in the sluiceways.

It will be appreciated that many variations in detail are possible without departing from the scope of the appended claims.

I claim:

1. A method of handling hot particulate material including the steps of producing a flow of liquid coolant of increasing depth over a solid surface, in which there is substantially no increase in the width of flow with increasing depth; introducing hot particulate material into the path of flow of coolant to create a temporary barrier arresting the flow of coolant; and allowing accumulated coolant to breach the barrier and carry away with it particulate material of the temporary barrier, the rate of flow of liquid coolant being sufficiently low that a protective layer of particulate material is formed on said surface to minimize wear of said surface.

2. A method as claimed in claim 1, wherein the particulate material is introduced into the path of flow of the coolant in such a manner that after breach of the temporary barrier further particulate material continues to move into the path of flow of the coolant, the flow of coolant after breach of the temporary barrier being such that it continues to carry away with it further particulate material entering the path of flow.

3. A method as claimed in claim 1, wherein hot particulate material is introduced intermittently into the path of flow of coolant in batch-wise fashion.

4. Means for handling hot particulate material including a longitudinally inclined sluiceway with a cross-sectional configuration such that there is substantially no increase in the width of a flow of liquid therealong with increasing depth; means defining a receiving zone transversely offset from the longitudinal centre line of the sluiceway to receive hot particulate material and to allow such material to enter the sluiceway; and means to introduce liquid coolant into the sluiceway to produce a flow of coolant at a low rate over substantially the entire width of the sluiceway past the region in which particulate material enters the sluiceway from the receiving zone, the sluiceway having a substantially plane bottom and sides, the sides being substantially vertical or inclined to converge upwardly.

5. Means as claimed in claim 4, wherein the receiving zone is adapted to allow particulate material to enter the sluiceway in such a manner in relation to the flow of coolant along the sluiceway that a temporary barrier of particulate material which can be breached and washed away by accumulated coolant is formed initially in the sluiceway, and after breach of the temporary barrier further particulate material continues to enter the sluiceway at such a rate that the flow of coolant can continue to carry such further particulate material away with it.

6. Means as claimed in claim 4, wherein the receiving zone comprises a ramp sloping downwardly towards the sluiceway at an angle to the longitudinal centre line of the sluiceway and in the general direction in which the sluiceway slopes.

7. Means as claimed in claim 4, wherein a plurality of spaced receiving zones are provided along the sluiceway.

8. Means as claimed in claim 7, including a plurality of branch sluiceways which are each provided with a plurality of receiving zones spaced therealong; and a main sluiceway to which the branch sluiceways are joined.

9. A method of handling hot particulate material including steps of producing a flow of liquid coolant of increasing depth in which there is substantially no increase in the width of flow with increasing depth and the rate of flow is low; receiving hot particulate material in a receiving zone offset transversely from the longitudinal center line of the path of flow of coolant; allowing particulate material to enter the flow path from the receiving zone under the influence of gravity at an angle to the longitudinal center line of the flow path and in the general direction of flow of coolant; creating a temporary barrier arresting the flow of coolant; and allowing accumulated coolant to breach the barrier and carry away with it particulate material of the temporary barrier.

10. A method of handling hot particulate material including the steps of producing a flow of liquid coolant of increasing depth at a low rate under sub-atmospheric pressure conditions, the flow of liquid being such that there is substantially no increase in the width of flow with increasing depth; introducing hot particulate material into the path of flow of coolant to create a temporary barrier arresting the flow of coolant; allowing accumulated coolant to breach the barrier and carry away with it particulate material of the temporary barrier; and withdrawing vapor formed when hot particulate material contacts the coolant.

11. A method as claimed in claim 10, wherein extracted vapour is condensed.

12. A method as claimed in claim 10, wherein dust is removed from the vapour.

13. A method of handling hot particulate material including the steps of producing a flow of liquid coolant of increasing depth along an enclosed passage under sub-atmospheric pressure, the flow of coolant being such that there is substantially no increase in the width of flow with increasing depth; receiving hot particulate material in a receiving zone offset transversely from the longitudinal center line of the path of flow of coolant; allowing particulate material to enter the flow path from the receiving zone under the influence of gravity at an angle to the longitudinal center line of the flow path and in the general direction of coolant flow; creating a temporary barrier arresting the flow of coolant; allowing accumulated coolant to breach the barrier and carry away with it particulate material of the temporary barrier, the rate of flow of coolant being low such that a protective layer of particulate material is formed on the surface over which flow occurs to minimize wear of the surface; allowing further particulate material to continue moving into the path of flow of coolant after breach of the temporary barrier, the flow of coolant after breach of the temporary barrier being such that it continues to carry away with it further particulate material entering the path of flow; allowing vapor to expand in the direction of flow of coolant; and extracting vapor from the enclosed passage to create a flow of vapor in the direction of flow of coolant.

14. Means for handling hot particulate material including a longitudinally downwardly inclined sluiceway of increasing depth with a substantially planar bottom and with substantially planar sides that are substantially vertical or upwardly convergent such that there is substantially no increase in width of flow of liquid along the sluiceway with increasing depth; a receiving zone comprising a ramp offset transversely from the longitudinal center line of the sluiceway and sloping downwardly toward the sluiceway to receive hot particulate material and allow such material to enter the sluiceway under the influence of gravity; and means to introduce liquid coolant turbulently at a low flow rate into the sluiceway to produce a flow of coolant which is dispersed over substantially the entire width of the sluiceway past the region in which particulate material enters the sluiceway from the receiving zone.

15. Means as claimed in claim 14, wherein the rate of introduction of liquid coolant into the sluiceway, the inclination of the sluiceway and the width of the sluiceway are related such that particulate material is washed down the sluiceway by the coolant at a rate such that a protective layer of particulate material is formed on the bottom of the sluiceway to minimize wear of the sluiceway.

16. Means for handling hot particulate material including an enclosed and longitudinally downwardly inclined sluiceway of increasing depth with a substantially planar bottom and with substantially planar sides that are substantially vertical or upwardly convergent such that there is substantially no increase in the width of a flow of liquid along the sluiceway with increasing depth; means defining a receiving zone transversely offset from the longitudinal center line of the sluiceway to receive hot particulate material and allow such material to enter the sluiceway; means to introduce liquid coolant into the sluiceway to produce a flow of coolant over substantially the entire width of the sluiceway past the region in which particulate material enters the sluiceway from the receiving zone; and means to produce sub-atmospheric pressure in the sluiceway.

17. Means as claimed in claim 16, wherein the cross-sectional area of the sluiceway increases in the direction in which the sluiceway slopes to present an expansion system to accommodate vapour surges which are generated when hot particulate material is introduced into the sluiceway.

18. Means as claimed in claim 17, including vapour extraction means operate to withdraw vapour from the sluiceway in the same direction in which the cross-sectional area of the sluiceway increases.

19. Means as claimed in claim 18, including means for condensing vapour extracted from the sluiceway.

20. Means as claimed in claim 19, wherein the condensing means is also operative to remove dust from extracted vapour.

21. Means for handling hot particulate material including an enclosed and longitudinally downwardly inclined sluiceway of increasing depth with a substantially planar bottom and with substantially planar sides that are substantially vertical or upwardly convergent such that there is substantially no increase in the width of a flow of liquid along the sluiceway with increasing depth; a receiving ramp offset transversely from the longitudinal center line of the sluiceway and sloping downwardly toward the sluiceway at an angle to the longitudinal center line of the sluiceway and in the general direction in which the sluiceway slopes to receive hot particulate material and allow such material to enter the sluiceway under the influence of gravity; means to introduce liquid coolant turbulently at a low flow rate into the sluiceway to produce a flow of coolant which is dispersed over substantially the entire width of the sluiceway past the region in which particulate material enters the sluiceway from the ramp, the cross-sectional area of the sluiceway increasing in the direction in which the sluiceway slopes downwardly to accommodate vapors which are generated when hot particulate material contacts coolant in the sluiceway; and vapor extraction means to withdraw vapor from the sluiceway in the same direction in which the cross-sectional area of the sluiceway increases.

* * * * *